US006981701B2

(12) United States Patent
Ritter et al.

(10) Patent No.: US 6,981,701 B2
(45) Date of Patent: Jan. 3, 2006

(54) FLUID-FILLED GAME DEVICE

(75) Inventors: Janice Ritter, Los Angeles, CA (US); Alton Takeyasu, Playa Del Rey, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/835,539

(22) Filed: Apr. 28, 2004

(65) Prior Publication Data

US 2005/0012274 A1 Jan. 20, 2005

Related U.S. Application Data

(60) Provisional application No. 60/466,818, filed on Apr. 29, 2003.

(51) Int. Cl.
*A63F 9/00* (2006.01)

(52) U.S. Cl. ..... 273/457

(58) Field of Classification Search ..... 273/457, 273/138.5, 458; 446/197, 267; D21/311
See application file for complete search history.

(56) References Cited

U.S. PATENT DOCUMENTS

| | | | | |
|---|---|---|---|---|
| 806,255 | A | 12/1905 | Hughes | |
| 925,209 | A | 6/1909 | Livermore | |
| 2,100,898 | A | 11/1937 | Bernett | |
| 2,151,589 | A | 3/1939 | Falls | |
| 2,174,305 | A | 9/1939 | Austin | |
| 3,367,308 | A | 2/1968 | Quattrone | |
| 3,646,696 | A | 3/1972 | Sarkisian | |
| 3,662,482 | A | 5/1972 | Sarkisian | |
| 3,687,110 | A | 8/1972 | Braunhut | |
| 4,032,141 | A | 6/1977 | Tanimura | |
| D250,357 | S | 11/1978 | Matsumoto | |
| 4,136,872 | A | 1/1979 | Matsumoto | |
| 4,142,715 | A | 3/1979 | Matsumoto | |
| 4,223,471 | A | 9/1980 | Greenberg | |
| D259,268 | S | 5/1981 | Itakura | |
| D263,606 | S | 3/1982 | Takahashi | |
| 4,362,299 | A | 12/1982 | Suzuki | |
| 4,363,483 | A | 12/1982 | Minami | |
| 4,382,597 | A | 5/1983 | Minami | |
| 4,508,336 | A | 4/1985 | Yokoi | |
| 4,529,207 | A * | 7/1985 | Iseki et al. | 273/457 |
| D300,753 | S | 4/1989 | Matsui | |
| 4,923,429 | A | 5/1990 | Lewis | |
| 4,990,118 | A | 2/1991 | Shiina | |
| 5,017,171 | A | 5/1991 | Shiina | |
| 5,098,111 | A | 3/1992 | Kashimoto | |
| D329,064 | S | 9/1992 | Nakazawa et al. | |

(Continued)

FOREIGN PATENT DOCUMENTS

| | | |
|---|---|---|
| GB | 2006627 | 5/1979 |

(Continued)

*Primary Examiner*—Raleigh W. Chiu
(74) *Attorney, Agent, or Firm*—Kolisch Hartwell, P.C.

(57) ABSTRACT

A game device is disclosed, including a tank charged with a fluid, a base for supporting the tank, the base further including a pump system to generate a fluid current within the tank, the pump system having a nozzle through which current is directed into the tank and an actuating system to operate the pump system, a play piece within the fluid having a specific gravity slightly greater than the fluid, the play piece further including a body portion and at least one protuberance extending outwardly from the body portion, wherein the at least one protuberance is adapted to impart one or more of rotational and translational motion to the play piece upon engaging a fluid current.

32 Claims, 5 Drawing Sheets

U.S. PATENT DOCUMENTS

| | | | |
|---|---|---|---|
| D329,471 | S | 9/1992 | Nakazawa et al. |
| D329,667 | S | 9/1992 | Nakazawa |
| 5,426,878 | A | 6/1995 | Branson |
| 5,924,691 | A | 7/1999 | Meng-Suen |
| 5,951,009 | A | 9/1999 | Miyamoto et al. |
| 6,068,262 | A | 5/2000 | Goldfarb et al. |

FOREIGN PATENT DOCUMENTS

| | | | | |
|---|---|---|---|---|
| GB | 2006627 | A | * | 5/1979 |

* cited by examiner

FLUID-FILLED GAME DEVICE

CROSS-REFERENCES

The present U.S. Patent application claims the benefit of priority under 35 U.S.C. § 120 to U.S. Patent Application Ser. No. 60/466,818, entitled "Liquid Filled Entertainment Device," filed on Apr. 29, 2003, incorporated herein by reference in its entirety for all purposes.

BACKGROUND AND SUMMARY OF THE DISCLOSURE

Embodiments of fluid-filled game devices are disclosed, which may include a tank charged with a fluid, a base for supporting the tank, and a user-actuated pump system for generating fluid currents within the tank. A plurality of semi-buoyant play pieces may be dispersed within the tank, each having protuberances extending outwardly from a body portion, wherein the protuberances may be adapted to impart motion to a play piece upon engaging a fluid current. The tank may further contain ornamental structures with moveable portions, which may be responsive to fluid currents, and may be configured to physically engage the play pieces. Optionally, ornamental structures may be coupled to a user-actuated mechanical system.

Examples of fluid-filled games operable to move semi-buoyant objects inside a liquid filled volume are disclosed in U.S. Pat. Nos. 806,255; 2,100,898; 4,032,141; 4,136,872; 4,142,715; 4,223,471; 4,362,299; 4,363,483; 4,382,597; 4,508,336; 4,923,429; 4,990,118; 5,017,171; 5,098,111; 5,426,878; 5,924,691; 5,951,009; 6,068,262; Des. 250,357; Des. 259,268; Des. 263,606; Des. 300,753; Des. 329,064; Des. 329,471; Des. 329,667; the disclosures of which are incorporated by reference in their entirety for all purposes.

DETAILED DESCRIPTION

Figure 1:
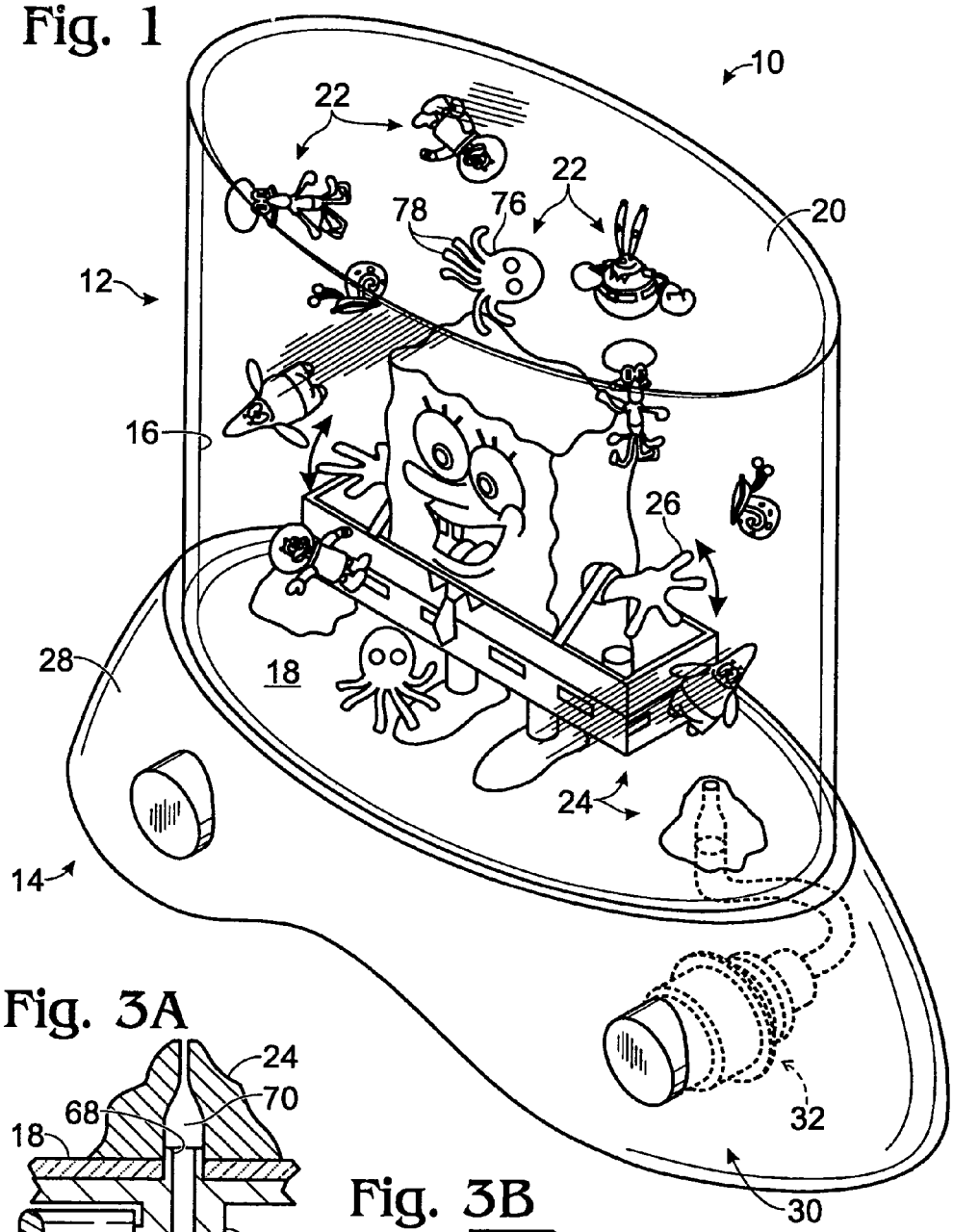
FIG. 1 is an isometric view of a fluid-filled game device with a tank disposed on a base, the tank containing play pieces and an ornamental structure with moveable parts, and the base shown to include two actuating devices and a pump system, a portion of which is shown as dashed structure.

FIG. 1 shows an exemplary embodiment of a game device 10, which may include a generally transparent tank 12 supported by a base 14. Tank 12 may be bounded by an interior surface 16 that may further include a bottom surface 18, and may be charged with a generally transparent fluid 20 such as water. Tank 12 may also contain a plurality of semi-buoyant play pieces 22 within fluid 20, as well as ornamental structures 24 mounted on interior surface 16. Ornamental structures 24 may be moveable with respect to interior surface 16, or may have moveable portions 26.

Base 14 may include a shaped exterior wall 28, configured to hold tank 12 in a generally upright orientation when device 10 is placed on a flat surface, and/or when held, such as in a user's hand. Base 14 also may include an actuating system 30, parts of which protrude outwardly from exterior wall 28. Actuating system 30 may be arranged to be manually engaged such as by a user's thumbs.

Base 14 also may include a pump system 32 operably coupled to actuating system 30. Pump system 32, a part of which is shown in FIG. 1 in dashed structure, may be configured to generate fluid currents within tank 12. These fluid currents may engage, and/or impart motion to, play pieces 22 and/or moveable portions 26 of ornamental structures 24. Such motion may provide entertainment value to a user of device 10.

Figure 2:
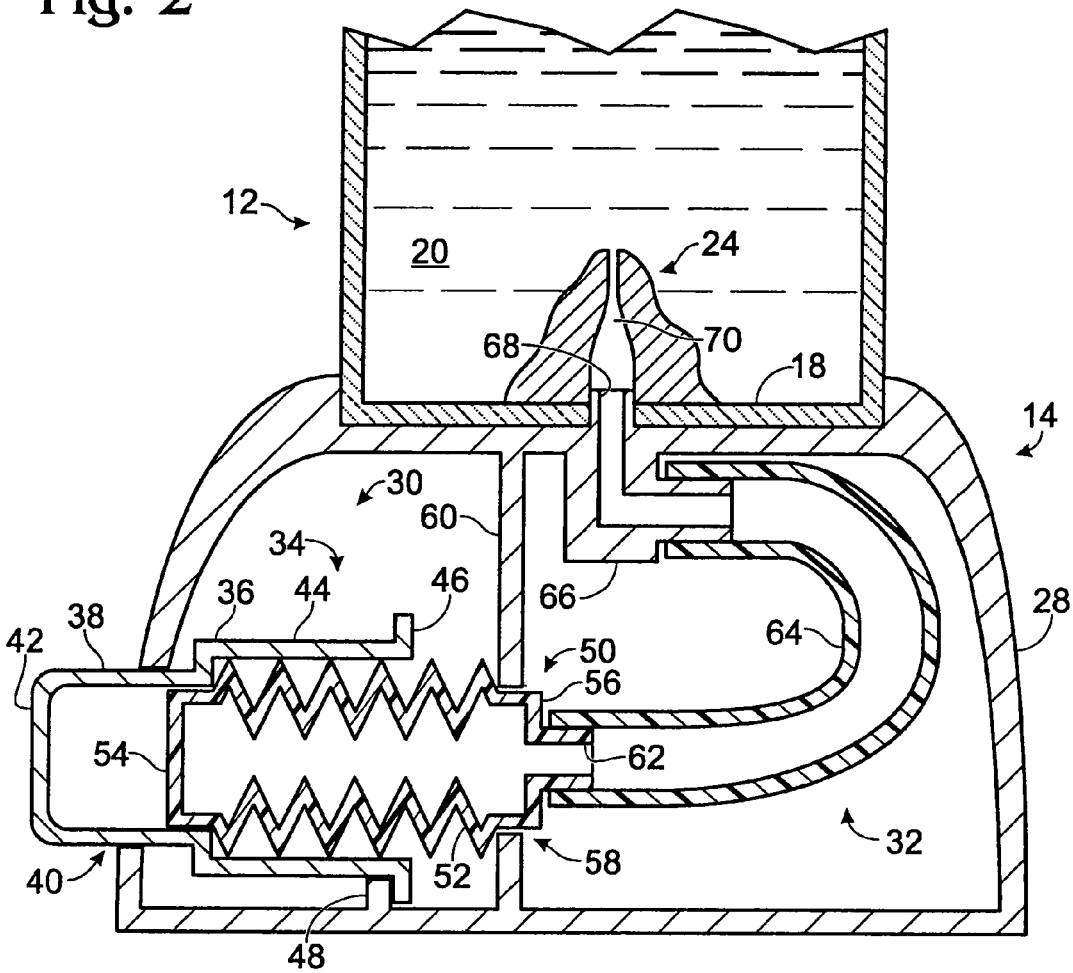
FIG. 2 is a cross-sectional view of the device of FIG. 1, showing components of an exemplary pump system.

FIG. 2 shows examples of structural elements that may be disposed within base 14, including exemplary components of actuating system 30 and pump system 32. Actuating system 30, which may include an actuating device 34, may be positioned substantially within base 14. A generally hollow, cup-shaped housing 36 of actuating device 34 may include a first end 38, part of which may protrude outwardly from exterior wall 28 through an opening 40, and which may terminate in a button 42. Housing 36 may also include a second end 44 terminating in an annular rim or flange 46. A brace or stop 48 may be provided to abut flange 46.

Pump system 32 also may be positioned within base 14, and may include a pump mechanism 50. A bellows 52 of pump mechanism 50 may include a closed end section 54, which may fit securely within first end 38 to effectively mount housing 36 on bellows 52. Bellows 52 may also include a shoulder 56 to fit securely within an aperture 58 in a support wall 60 of base 14, stabilizing bellows 52 within base 14.

A hollow boss 62 on bellows 52, generally within shoulder 56, may be connected by a length of tubing 64 to a fitting 66, which may terminate in a nozzle 68. Nozzle 68 may protrude generally upwardly through bottom surface 18 of tank 12.

In some embodiments, such as those shown in FIGS. 1 and 2, nozzle 68 may be coupled to ornamental structure 24 within tank 12, such that fluid may move through nozzle 68 through a channel 70 in ornamental structure 24, or through channel 70 into nozzle 68. In some embodiments, nozzle 68 may simply protrude into tank 12 without any additional structure coupled to the nozzle, such as that depicted in FIG.

Figure 3A:
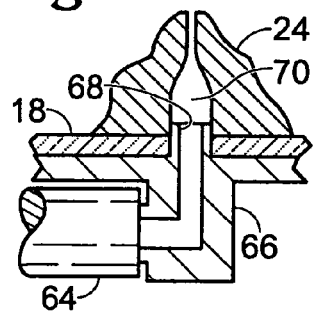
FIGS. 3A–3D are cross-sectional views of various nozzle configurations suitable for use in the device of FIG. 1.
Figure 3B:
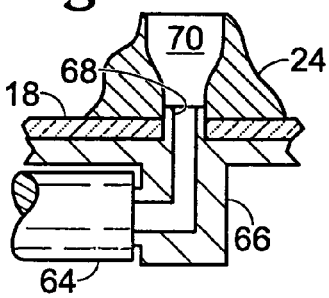
Figure 3C:
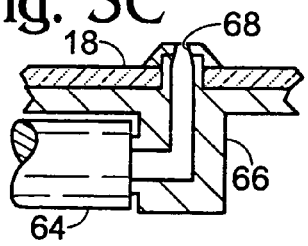
Figure 3D:
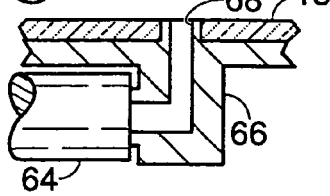

3C. In other embodiments, such as shown in FIG. 3D, nozzle 68 may be flush with bottom surface 18 of tank 12.

Pump system 32 may be coupled to actuating system 30 such that the actuating system may operate pump system 32 to produce fluid currents within tank 12 that flow through nozzle 68.

Figure 4A:
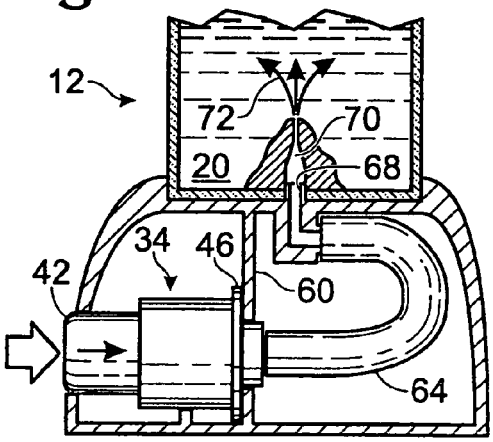
FIGS. 4A–4B are simplified cross-sectional views of the device of FIG. 1, illustrating the operation of components of an exemplary pump system.

For example, bellows 52 may be compressed by a force applied to button 42, such as by a player's thumb, to move actuating device 34 inwardly in a direction toward base 14, until flange 46 abuts support wall 60, as shown in FIG. 4A. Compression of bellows 52 may cause a flow or current of fluid 20 to be forced through tubing 64 and ejected from nozzle 68 through channel 70 and into tank 12, generally in the direction in which nozzle 68 is oriented. Ejection of fluid 20 from nozzle 68 into tank 12 may generate fluid currents within tank 12, as indicated by arrows 72.

Figure 4B:
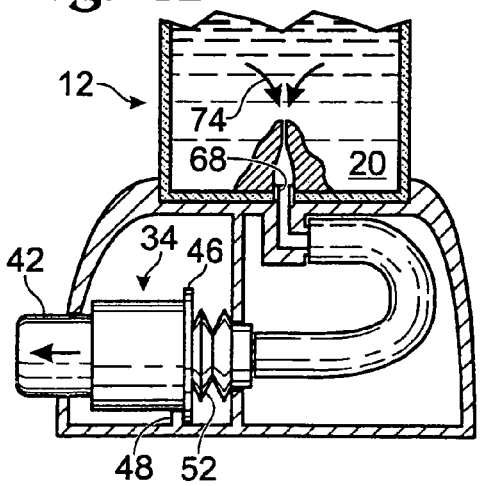

Upon release of force applied to compress bellows 52, the structural resiliency of the bellows and the weight of fluid 20 in tank 12 may be sufficient to automatically expand bellows 52 and urge actuating device 34 outwardly in a direction away from base 14, until flange 46 abuts stop 48, as shown in FIG. 4B. Optionally, expansion of bellows may optionally be assisted by use of a spring (not shown) or other urging or biasing member. Expansion of bellows 52 may result in a flow of fluid 20 from tank 12 back through nozzle 68. Flow of fluid 20 into nozzle 68 also may generate fluid currents within tank 12, as indicated by arrows 74.

Figure 5:
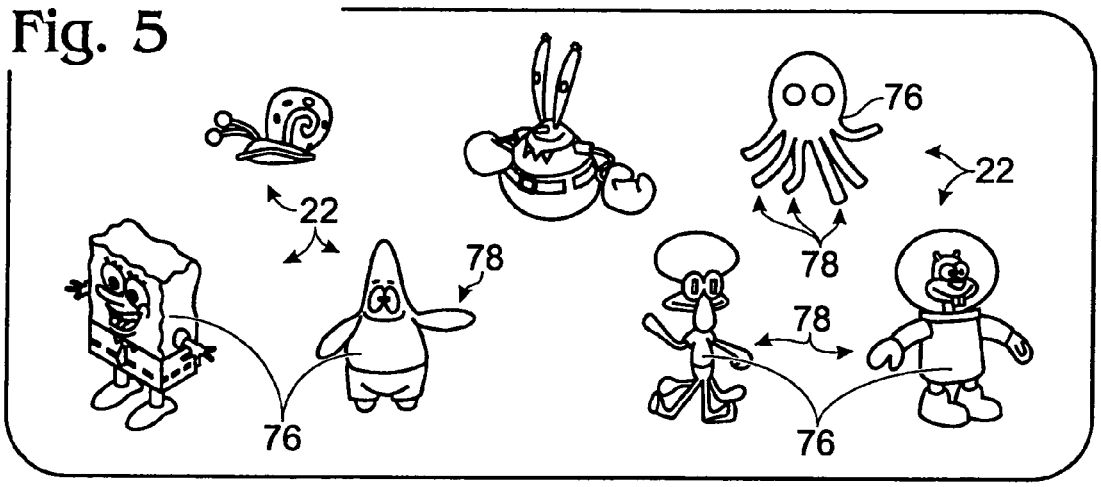
FIG. 5 depicts various play pieces suitable for use in the device of FIG. 1.

Referring again briefly to FIG. 1, dispersed throughout fluid 20 in tank 12 is a plurality of semi-buoyant play pieces 22, which may be adapted to move around in response to fluid currents generated in tank 12. As can also be seen in FIG. 5, each play piece may include a body portion 76 and a plurality of protuberances 78 extending outwardly from the body portion. In the depicted embodiment, play pieces 22 and ornamental structures 24 resemble characters and scenery from the children's cartoon SPONGEBOB SQUAREPANTS®, but other embodiments may be based on different themes, combinations thereof, or no theme.

Play pieces 22 may be formed of a material such as known polyolefin or vinyl polymer of a specific gravity slightly greater than that of the surrounding fluid, to provide the illusion that play pieces are suspended in fluid 20. Such material may optionally have sufficient flexibility to allow protuberances 78 to move relative to body portion 76, to provide the illusion of independent animation as the play pieces move through fluid 20. The flexibility and seeming suspension of the play pieces in fluid 20 may create the appearance that play pieces 22 swim around in an underwater setting, enhancing the entertainment value of device 10.

Further, the resiliency or flexibility of protuberances 78 may impart rotational and/or translational motion to the play pieces upon engagement with fluid currents within tank 12, generated, for example, by operation of pump system 32, causing play pieces 22 to move in a tumbling, swirling motion through fluid 20. The tumbling, swirling motion of play pieces 22 within tank 12 may further enhance the entertainment value of device 10.

Other features of device 10 also may be configured to enhance play. For example, the configuration of pump system 32 may include additional structure such as manifolds, joints, fittings, and the like, to direct fluid flow to a plurality of nozzles disposed within the tank. Similarly, actuating system 30 may include additional structure such as additional actuating devices and/or buttons. Thus, device 10 may contain a plurality of pump mechanisms operable by means of a corresponding plurality of buttons.

Ornamental structures 24 within tank 12 may also be configured to enhance play, for example, by taking a variety of different forms, some of which may include moveable portions 26. Moveable portions 26 may be configured, for example, to physically engage play pieces 22 and/or to create turbulence in fluid 20 by moving relative to the ornamental structure, either of which may alter the movement of play pieces 22, further augmenting the entertainment value of the device.

Figure 6:
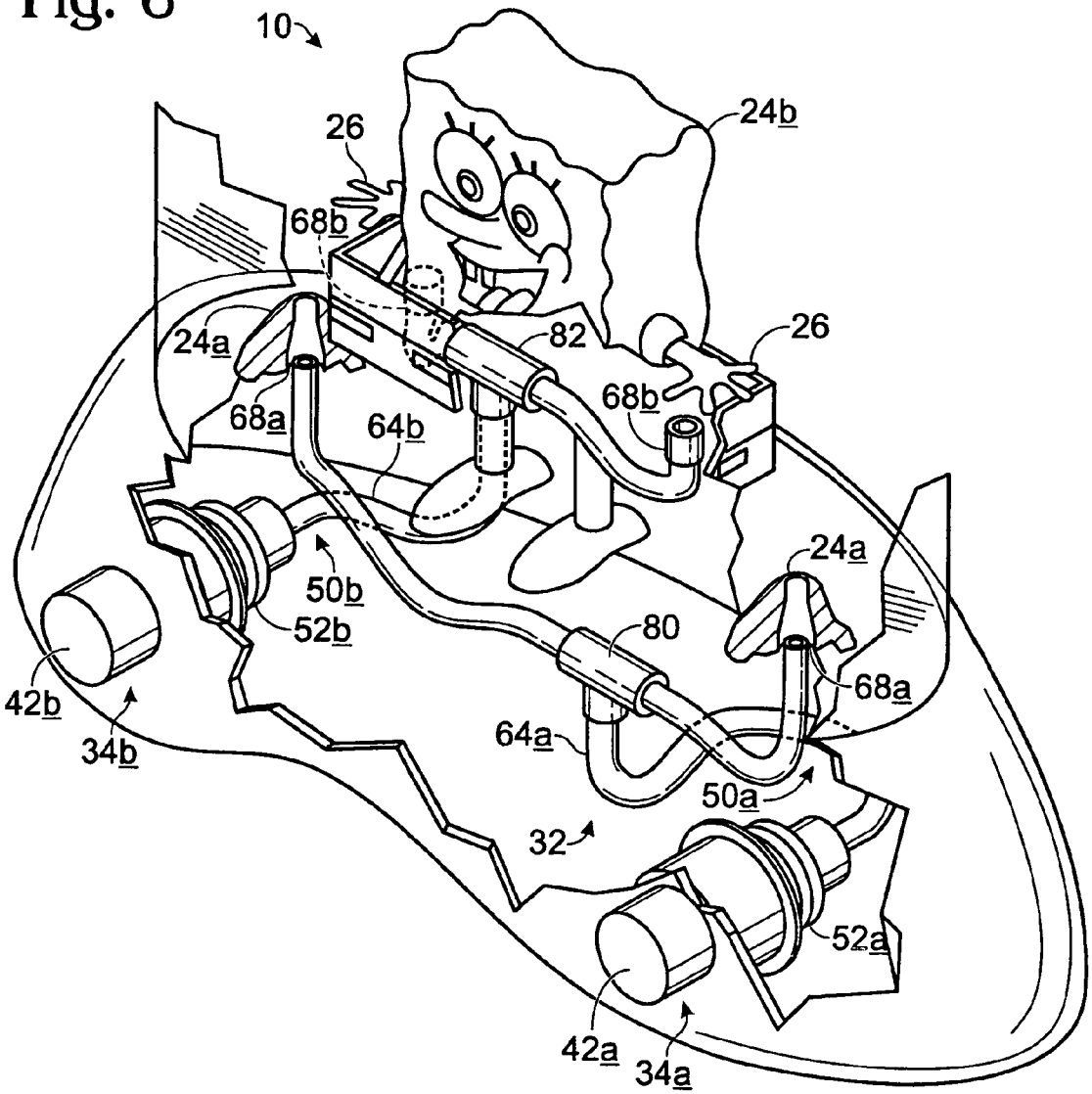
FIG. 6 is an isometric view of parts of the device of FIG. 1, with portions of the exterior surfaces cut away to show internal structure.

FIG. 6 depicts device 10 of FIG. 1 with portions cut away to reveal internal structure, to illustrate exemplary configurations as described above. Ornamental structures 24 (specifically, 24*a* and 24*b*) are disposed on bottom surface 18. Moveable portions 26 may be hingedly connected to ornamental structure 24*b*, or may be formed of a material of sufficient resiliency to allow movement relative to ornamental structure 24*b*.

In the depicted example, ornamental structure 24*b* is shaped to resemble the cartoon character SPONGEBOB SQUAREPANTS®, and moveable portions 26 are shaped to resemble the character's arms. Continuing the theme, ornamental structure 24*a* is shaped to resemble a coral formation or an underwater volcano.

The device of FIG. 6 also may include pump system 32, which may further include a first pump mechanism 50*a* disposed in base 14. Pump mechanism 50*a* may have a bellows 52*a*, coupled by a length of tubing 64*a* to a lower manifold 80, which in turn may be coupled to two nozzles 68*a* disposed on bottom surface 18 of tank 12.

Pump system 32 also may include a second pump mechanism 50*b* partially disposed in ornamental structure 24*b*. Second pump mechanism 50*b* may include a bellows 52*b* coupled by a length of tubing 64*b* to an upper manifold 82 within ornamental structure 24*b*. Upper manifold 82 in turn may be coupled to two nozzles 68*b* disposed within ornamental structure 24*b*, which may be oriented generally toward moveable portions 26.

Pump system 32 may be coupled to actuating system 30, which may include separate actuating devices 34*a*, 34*b* to operate each of pump mechanisms 50*a*, 50*b*. For example, first pump mechanism 50*a* is coupled to first actuating device 34*a*, and second pump mechanism 32*b* is coupled to second actuating device 34*b*.

Each of pump mechanisms 50*a*, 50*b* may be operated by force applied to buttons 42*a*, 42*b*, such as by a player's thumbs. As described in greater detail above, force applied to button 42*a* may generate fluid currents within tank 12, expelled from nozzles 68*a*. Analogously, force applied to button 42*b* may generate fluid currents, expelled from nozzles 68*b*, which may be oriented such that fluid currents expelled therefrom will engage moveable portions 26, causing the "arms" to move up and down.

Thus, in the exemplary embodiment depicted in FIGS. 1 and 6, play pieces 22 may swirl and tumble around in fluid 22 in response to fluid currents expelled from nozzles 68*a*, 68*b*, turbulence created by the movement of moveable portions 26, physical contact with moveable portions 26 or with other play pieces 22, or any combination thereof. Such fluid currents, turbulence, and movement may be generated by operation of buttons 42*a*, 42*b*, such as by a user of device 10.

Using the concepts described above, several variations are possible in the configuration of one or more components of devices according to the present disclosure. For example, moveable portions of ornamental structures may be configured to move by mechanical means alternatively or in addition to moving in response to fluid flow.

Figure 7:
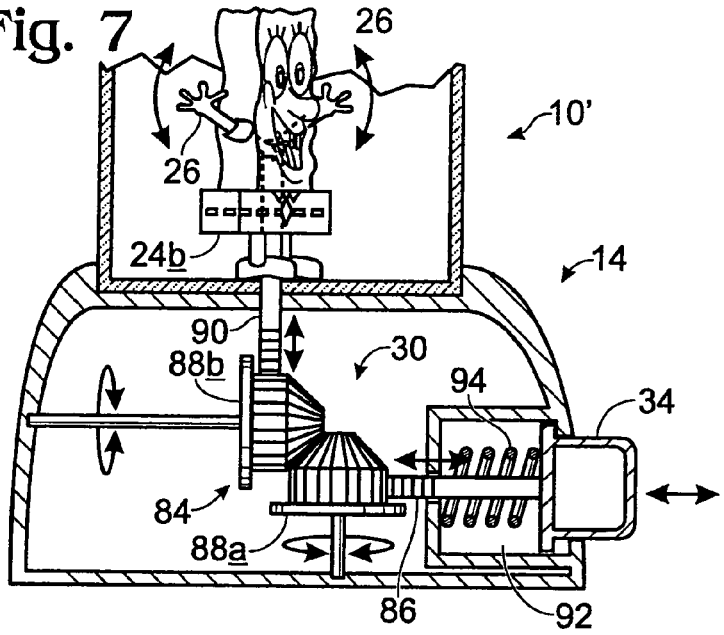
FIG. 7 is a cross-sectional of the device of FIG. 1, showing components and operation of an exemplary mechanical system to move parts of the ornamental structure.

FIG. 7 illustrates such an exemplary configuration in a device labeled 10' to indicate the inclusion of structural components, such as various mechanical members, which may not be included in device 10. Specifically, actuating system 30 may be coupled to a gear assembly 84 or other mechanical members disposed within base 14, including a strut 86 coupled to actuating device 34. Strut 86 may engage a pair of intermeshing gears 88*a*, 88*b*, which are coupled to a post 90 hingedly connected to moveable portions 26 of ornamental structure 24*b*.

Actuating device 34 may be partially housed in a compartment 92 and coupled to a biasing member 94 such as a spring. Thus, force exerted to move actuating device 34 inwardly toward base 14 may result in movement of moveable portions 26 in an up-and-down motion relative to ornamental structure 24*b*. Upon release of force applied, actuating device 34 may then be urged outwardly from base 14 by biasing member 94 as allowed by the configuration of compartment 92.

Figure 8:
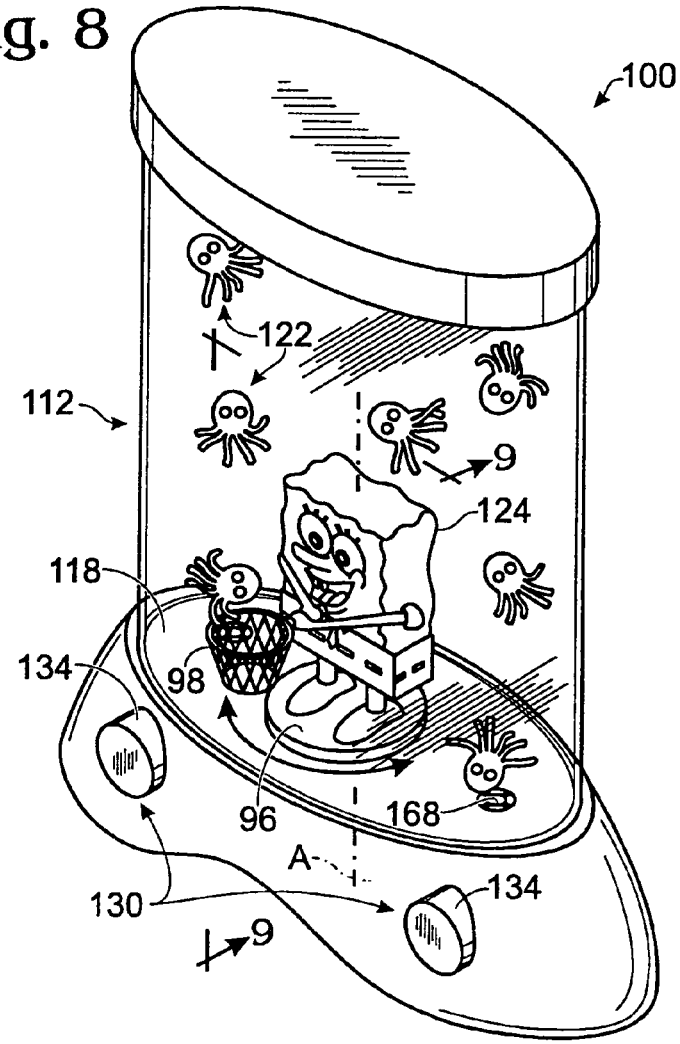
FIG. 8 is an isometric view of another fluid-filled game device with a tank disposed on a base, the tank containing play pieces and a moveable ornamental structure, and the base shown to include two actuating devices.

In other embodiments, ornamental structures mounted to an interior surface of the tank may be configured to move in entirety, in addition or alternatively to having moveable portions. For example, FIG. 8 depicts a device 100 which may include an ornamental structure 124 mounted to a bottom surface 118 of a tank 112 by means of a support 96. Support 96 may be configured to move relative to bottom surface 118, correspondingly moving ornamental structure 124. Specifically, support 96 (and thus ornamental structure 124) may pivot about a vertically oriented axis (indicated at A). Further, ornamental structure 124 may include a target region 98.

Device 100 may also include a plurality of nozzles 168 disposed on bottom surface 118. Analogous to embodiments described above, device 100 may also include an actuating system 130 including two actuating devices 134, one of which may be operably coupled to a pump system (not shown) to generate fluid current in tank 112 through nozzles 168, and the other of which may be configured to pivot ornamental structure 124 from side to side.

Figure 9:
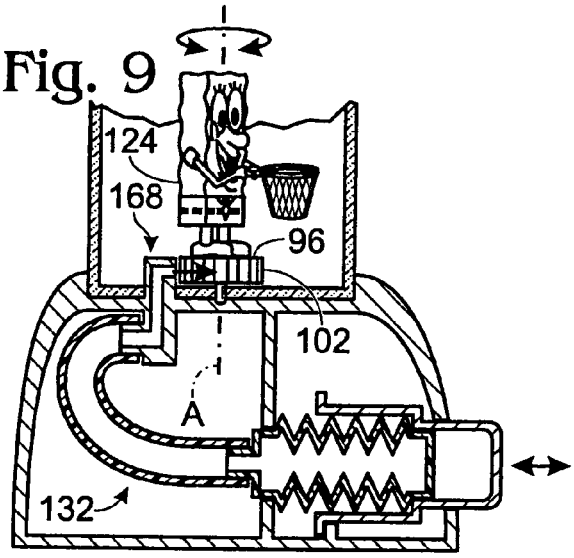
FIG. 9 is a cross-sectional view of the device of FIG. 8, showing components and operation of an exemplary pump system to move an ornamental structure.
Figure 10:
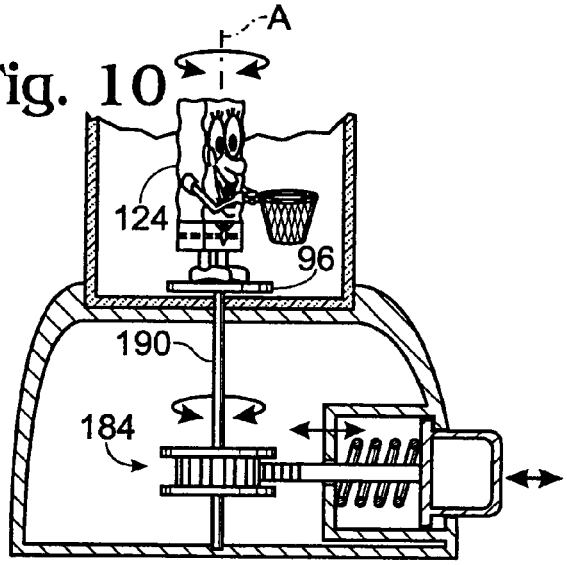
FIG. 10 is a cross-sectional view of the device of FIG. 8, showing components and operation of an exemplary mechanical system to move an ornamental structure.

Ornamental structure 124 may be pivoted, for example, as depicted in FIG. 9, wherein a nozzle 168 may be oriented to direct fluid current generated by a pump system 132 into a turbine 102 disposed in support 96. Optionally, as depicted in FIG. 10, actuating system 130 may be coupled to a gear assembly 184, operable to pivot a post 190 coupled to support 96.

A user of device 100 may thus generate fluid currents within tank 112 and pivot ornamental structure 124 and target region 96 using actuating devices 134, moving and attempting to catch play pieces 122.

Variations also are possible in other component configurations. For example, some embodiments may include an actuating system with only one actuating device configured to move play pieces and to move moveable portions of ornamental structures.

Figure 11:
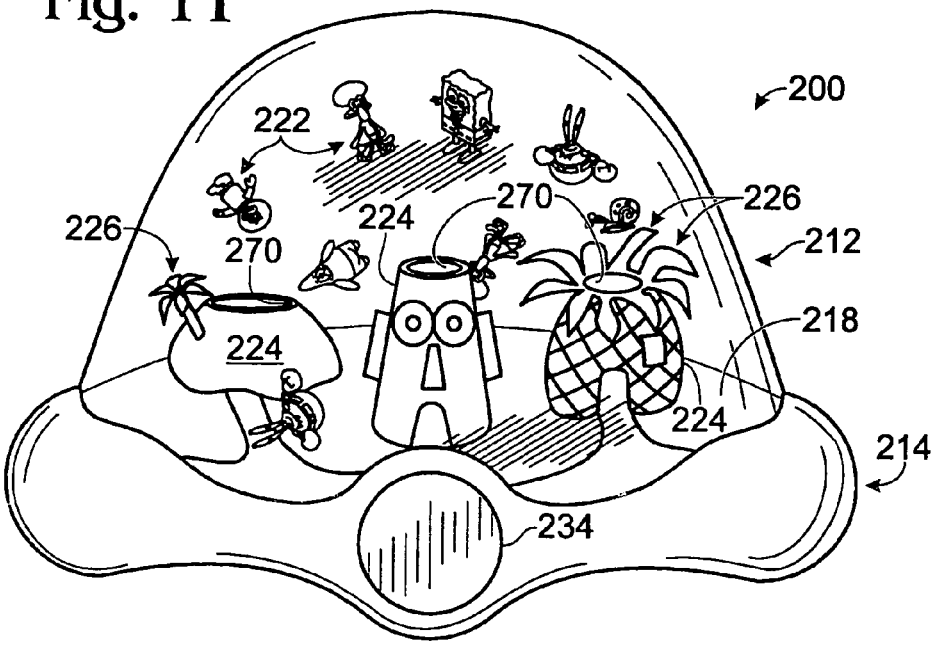
FIG. 11 is an isometric view of yet another fluid-filled entertainment device with a tank disposed on a base, the tank containing play pieces and three ornamental structures, and the base shown to include one actuating device.

For example, FIG. 11 depicts a device 200 which may include a fluid-filled tank 212 with a plurality of semi-buoyant play pieces 222 dispersed therein and three ornamental structures 224 disposed on a bottom surface 218. Each of ornamental structures 224 may optionally include moveable portions 226 and/or an interior channel 270, sized and shaped to accommodate one of play pieces 222. In the depicted example, ornamental structures 224 are shaped to resemble houses and other items based on the SPONGEBOB SQUAREPANTS® theme.

Nozzles (not shown) may be disposed within channels 270, configured to direct fluid currents generated by a pump system (not shown) disposed within a base 214 and coupled to an actuating system (not shown) that may include an actuating device 234. Actuating device 234 may additionally be operable to eject fluid currents to move moveable portions 226.

A user of device 200 may thus generate fluid currents within tank 212 using actuating device 234, causing moveable portions 226 to move and causing play pieces 222 to swirl and tumble around and perhaps move into channels 270.

It will be appreciated that other variations are also possible within the configuration of other components of the exemplary devices herein described, and/or their inclusion or arrangement within the devices. For example, channels within ornamental structures may be sized and shaped to vary the force with which fluid current is expelled into a tank, and/or may further include irregularities, baffles, or other interior surface structure configured to create turbulence in a fluid current expelled from a nozzle, resulting in erratic and/or unpredictable movement of play pieces.

In a pump mechanism, tubing may be fabricated of a non-elastic material, or may be optionally be formed of a somewhat elastomeric material so that it may tend to expand as a bellows is compressed and fluid flows from the bellows. When formed of such a material, the tubing may act as an accumulator in that as the bellows is compressed and shortly thereafter, the fluid flow from the bellows may be sustained to a minor extent as the tubing contracts after bellows has been fully compressed.

While the inventions defined in the following claims have been particularly shown and described with reference to the foregoing examples, those skilled in the art will understand that many variations may be made therein without departing from the spirit and scope of the inventions. Other combinations and sub-combinations of features, functions, elements, component, actions, and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present disclosure.

The foregoing embodiments are illustrative, and no single feature, component, or action is essential to all possible combinations that may be claimed in this or later applications. Where the claims recite "a" or "a first" element or the equivalent thereof, such claims should be understood to include one or more such elements, neither requiring nor excluding two or more such elements. Further, cardinal indicators, such as first, second, and third, for identified elements or actions are used to distinguish between the elements and actions, and do not indicate a required or limited number of such elements or actions, nor does it indicate a particular position or order of such elements or actions unless otherwise specifically stated.

We claim:

1. A device, comprising:

a tank charged with a fluid;

a base for supporting the tank, the base further including:

a pump system to generate a fluid current within the tank, the pump system having a nozzle through which current is directed into the tank;

an actuating system to operate the pump system;

a play piece within the fluid having a specific gravity slightly greater than the fluid, the play piece further including:

a body portion; and at least one protuberance extending outwardly from the body portion;

wherein the at least one protuberance is configured to move relative to the body portion and adapted to impart one or more of rotational and translational motion to the play piece upon engaging a fluid current.

2. The device of claim 1 wherein the base further includes an exterior surface and wherein at least part of the actuating system is disposed on the exterior surface.

3. The device of claim 2 wherein the part of the actuating system disposed on the exterior surface includes a button.

4. The device of claim 3 wherein the base is adapted to be hand-held.

5. The device of claim 3 wherein the base is adapted to hold the device generally upright on a surface.

6. The device of claim 1, wherein the tank further includes:

an interior surface; and an ornamental structure mounted on the interior surface.

7. The device of claim 6 wherein the nozzle is disposed on the interior surface.

8. The device of claim 7 wherein the nozzle is coupled to the ornamental structure.

9. The device of claim 6 wherein the nozzle includes a plurality of nozzles, and wherein the pump system is configured to generate fluid current through each of the plurality of nozzles.

10. The device of claim 9, wherein at least one of the plurality of nozzles is coupled to the ornamental structure.

11. The device of claim 6, wherein at least a portion of the ornamental structure is adapted to be moveable with respect to the tank.

12. The device of claim 11, wherein the moveable portion of the ornamental structure is adapted to engage the play piece.

13. The device of claim 12 wherein the nozzle is configured to direct fluid current to move at least the moveable portion of the ornamental structure.

14. The device of claim 11 wherein the nozzle includes a plurality of nozzles, at least one of which is configured to move at least the moveable portion of the ornamental structure.

15. The device of claim 13, wherein the base further includes:

a mechanical member coupled to the moveable portion of the ornamental structure;

an actuating device to operate the mechanical member; and an exterior surface;

wherein at least part of the actuating device is disposed on the exterior surface.

16. The device of claim 15, wherein the part of the actuating device disposed on the exterior surface includes a button.

17. The device of claim 2, wherein the pump system includes a first pump mechanism and a second pump mechanism, each pump mechanism further including a nozzle through which current is directed into the tank;

wherein the actuating device includes a first actuating device to operate the first pump mechanism and a second actuating device to operate the second pump mechanism.

18. The device of claim 17, wherein the first actuating device includes a first button and the second actuating device includes a second button, and wherein the first button and the second button are disposed on the exterior surface.

19. The device of claim 17, wherein the tank further includes:

an interior surface; and ornamental structure mounted on the interior surface, at least a portion of which is adapted to be moveable with respect to the tank;

wherein the nozzle of the first pump mechanism is configured to move the moveable portion of the ornamental structure; and wherein the nozzle of the second pump mechanism is configured to direct fluid current to engage the play piece.

20. The device of claim 1, wherein at least a portion of the tank is transparent.

21. A device, comprising:

a tank charged with a fluid, the tank including an interior surface;

a play piece within the fluid having a specific gravity slightly greater than the fluid, wherein the play piece further includes:

a body portion; and at least one protuberance extending outwardly from the body portion;

ornamental structure mounted on the interior surface, at least a portion of which is adapted to be moveable with respect to the tank;

a base for supporting the tank, the base further including:

a first pump mechanism and a second pump mechanism, each pump mechanism operable to generate a fluid current within the tank; and a first actuating device to operate the first pump mechanism and a second actuating device to operate the second pump mechanism;

wherein the first pump mechanism is configured to generate a fluid current to move the play piece within the fluid, wherein the second pump mechanism is configured to move the moveable portion of the ornamental structure, and wherein the at least one protuberance is adapted to impart one or more of rotational and translational motion to the play piece upon engaging a fluid current.

22. The device of claim 21, wherein the moveable portion of the ornamental structure is adapted to engage the play piece.

23. The device of claim 22, wherein each actuating device includes a button.

24. A device, comprising:

a tank charged with a fluid, the tank having a bottom surface;

a play piece within the fluid having a specific gravity slightly greater than the fluid, the play piece including:

a body portion; and at least one protuberance extending outwardly from the body portion;

a pump mechanism to generate a fluid current within the tank;

an actuating device to operate the pump mechanism;

a plurality of ornamental structures mounted on the bottom surface, each structure including a substantially vertically-oriented cavity sized to accommodate a play piece; and a corresponding plurality of nozzles, each nozzle configured to direct a fluid current substantially upward through a cavity, to engage a play piece within the cavity;

wherein the at least one protuberance is adapted to impart one or more of rotational and translational motion to the play piece upon engaging a fluid current.

25. The device of claim 24 wherein the device further comprises a base to support the tank, wherein the pump mechanism is disposed within the base, and wherein at least a part of the actuating device is disposed on the base.

26. The device of claim 25 wherein the part of the actuating device disposed on the base includes a button.

27. A device, comprising:

a fluid-filled tank having an interior surface;

a base for supporting the tank;

an ornamental structure mounted on the interior surface, at least a portion of which is adapted to be moveable with respect to the tank;

a mechanical member disposed at least partially within the base, the mechanical member adapted to move the moveable portion of the ornamental structure;

a play piece within the fluid having a specific gravity slightly greater than the fluid;

a pump system operable to generate a fluid current within the tank to move the play piece within the fluid.

28. The device of claim 27, wherein the play piece further includes:

a body portion; and at least one protuberance extending outwardly from the body portion;

wherein the at least one protuberance is adapted to impart one or more of rotational and translational motion to the play piece upon engaging a fluid current.

29. The device of claim 28, further including:

a first actuating device disposed on the base to operate the pump system;

a second actuating device disposed on the base to operate the mechanical member.

30. The device of claim 29, wherein the moveable portion of the ornamental structure is adapted to engage the play piece.

31. A device, comprising:

a fluid-filled tank having an interior surface;

a play piece within the fluid having a specific gravity slightly greater than the fluid;

an ornamental structure mounted on the interior surface, at least a portion of which is adapted to be moveable with respect to the tank;

means to generate fluid currents within the tank to move the play piece within the fluid; and means to move the movable portion of the ornamental structure.

32. A device, comprising:

a tank charged with a fluid;

a base for supporting the tank, the base further including:

fluid generating means for generating a fluid current within the tank, said fluid generating means having a nozzle through which current is directed into the tank;

actuating means to operate the fluid generating means;

a play piece within the fluid having a specific gravity slightly greater than the fluid, the play piece further including:

a body portion; and at least one protuberance extending outwardly from the body portion;

wherein the at least one protuberance is configured to move relative to the body portion and adapted to impart one or more of rotational and translational motion to the play piece upon engaging a fluid current.

* * * * *